US005504466A

United States Patent [19]

Chan-Son-Lint et al.

[11] Patent Number: 5,504,466

[45] Date of Patent: Apr. 2, 1996

[54] SUSPENDED DIELECTRIC AND MICROSTRIP TYPE MICROWAVE PHASE SHIFTER AND APPLICATION TO LOBE SCANNING ANTENNE NETWORKS

[75] Inventors: Bernard J. Chan-Son-Lint, St Orens De Gameville; Christian Pouit, Saint Cloud, both of France

[73] Assignee: Office National d'Etudes et de Recherches Aerospatiales, Chatillon, France

[21] Appl. No.: 75,680

[22] Filed: Jul. 10, 1987

[30] Foreign Application Priority Data

Jul. 4, 1986 [FR] France ..... 86 09780

[51] Int. Cl.[6] ..... H01P 1/18; H01P 3/00; H01P 9/00

[52] U.S. Cl. ..... 333/159; 342/372; 343/700 MS File

[58] Field of Search ..... 342/372, 155; 333/159, 157, 139, 233, 248; 343/700 MS File, 768, 785

[56] References Cited

U.S. PATENT DOCUMENTS 4,575,697 3/1986 Rao et al. ..... 333/159 X
4,587,525 5/1986 Parsons ..... 343/821
4,623,894 11/1986 Lee et al. ..... 343/700 MS File
4,724,443 2/1988 Nysen ..... 343/700 MS File
4,768,001 8/1988 Chan-Son-Lint et al. ..... 333/159

OTHER PUBLICATIONS

*Product News,* Electronic Specialty Co., May 1964.

*Primary Examiner*—Theodore M. Blum
*Attorney, Agent, or Firm*—Laubscher & Laubscher

[57] ABSTRACT

A microwave phase shifter comprises superposed conductor and dielectric plates, and a conductor strip carried by the dielectric plate. It comprises means, such as a piezoelectric biplate, for moving one of the plates in relation to the other thereby modifying the thickness of an air gap between the plates and consequently, modifying the phase constant of the phase shifter. The phase shifter can comprise at least one microstrip type impedance transformer in order to match to a microwave transmission line. When radiating elements are linked along the conductor strip, the phase shifter forms a lobe scanning network antenna.

37 Claims, 7 Drawing Sheets

SUSPENDED DIELECTRIC AND MICROSTRIP TYPE MICROWAVE PHASE SHIFTER AND APPLICATION TO LOBE SCANNING ANTENNE NETWORKS

BACKGROUND OF THE INVENTION

1. Field of the Invention

This invention relates in general to a microwave phase shifter element with a microstrip type structure and capable of being integrated into a network antenna. This structure comprises a ground conductor plate, a superposed dielectric plate substantially parallel to the conductor plate, and a conductor strip carried by a major face of the dielectric plate.

2. Description of the Prior Art

Such known phase shifters are ferrite phase shifters including a ferrite plate between the conductor and dielectric plates. The merit of the ferrite microstrip phase shifter is that it can be integrated into a hybrid microelectronic network antenna.

Nevertheless, a ferrite microstrip phase shifter offers somewhat limited performance. The drawbacks of a ferrite phase shifter are basically as follows:

- relatively high insertion losses, typically higher than 1 dB for an operating frequency of approximately 10 GHz to obtain a 360° phase shift;
- relatively high power requirement, in the region of a few hundred milliwatts;
- limited use in frequency, typically frequencies less than approximately 20 GHz;
- the need to correct the current control law when the operating temperature varies, owing to the temperature sensitivity of the magnetic features of the ferrite; and
- relatively limited peak power holding to avoid an increase in the insertion losses of the phase shifter.

OBJECTS OF THE INVENTION

The main object of this invention is to provide a reciprocal, microstrip structure type phase shifter element as set forth above, that can be used in microwaves both in the centrimetric and millimetric wave range, and thus is capable of offering a large passband, of several octaves.

Another object of this invention is to produce a phase shifter having radio-electric performances better than the ferrite microstrip phase shifters.

A further object of this invention is to provide a phase shifter element having a very low control power requirement in the region of a few milliwatts, and very low dimensions, and compatability in view of applications to two-plane lobe scanning antenna networks.

SUMMARY OF THE INVENTION

Accordingly, there is provided a phase shifter element comprising a microwave phase shifter element including a conductor plate, a dielectric plate superposed and substantially parallel to the conductor plate, a conductor strip carried by a major face of the dielectric plate, an air gap having a variable thickness and located between the dielectric plate and the conductor plate, and means for moving one of the plates in relation to the other, thereby modifying the thickness of the air gap.

According to a preferred embodiment offering great compactness, a very low weight, and the advantage of an electronic control, the moving means is a piezoelectric means carrying the movable plate and deformable by supply of a variable control voltage, and consists of a piezoelectric biplate. The dielectric plate is stationary. The biplate carries the conductor plate and moves it between a first position remote from the dielectric plate and a second position substantially in contact with the dielectric plate.

The phase shifter element thus offers the following advantages:

- Fully reciprocal phase shifting thus suited to transmit/receive applications;
- Radioelectric performances better than any other type of phase shifter;
  - highly efficient: very great phase shift per unit of length, and
  - high merit factor: very low insertion losses, typically less than 0.5 dB.
- Very wide frequency band; in fact the phase shifter element operates in TEM mode and in principle has no cutoff frequency; towards the high frequency ranges, the phase shifter element can include means for reducing radiation losses so as to form a high performance structure of suspended dielectric "strip line" type; the phase shifter element can be used up to 150 GHz and above;
- In principle, fairly insensitive to temperature; in fact piezoelectric materials are available whose $d_{33}$ load coefficient remains constant throughout a broad temperature range;
- Control power, in the case of a phase shifter element including moving piezoelectric means practically zero in steady state, relatively low in switched state;
- Microelectronic structure well suited to the hybrid integrated circuit;
- Simple to use:
  - microstrip microwave structure very simple to produce and hence inexpensive;
  - relatively simple assembly;
  - control circuit geometrically decoupled from the microwave circuit for controlling the moving means;
- Reduced size, compatible with applications relative to a two-plane electronic scanning network antenna.

According to a first application, the phase shifter element embodying the invention is included in a microwave phase shifter device that can be inserted into a microwave circuit. A phase shifter device embodying the invention includes a phase shifter element embodying the invention and at least one impedance transformation means linked to one of the ends of the conductor strip and conductor plate for matching characteristic impedance of the phase shifter element to that of external microwave means. The transformation means also has a microwave microstrip type structure including a conductor strip linked to the one end of the conductor strip of the phase shifter element and having a width reducing continuously or discretely by stages from, at the most, that end.

According to a second application, a phase shifter element includes a conductor strip linked to radiating conductor elements carried by the dielectric plate and spaced out along the conductor strip, thereby forming a network antenna whose lobe scanning is controlled by displacement of the conductor plate in the phase shifter element.

According to a third application, a first phase shifter element embodying the invention includes several parallel conductor strips carried by the major face of the dielectric plate, and radiating conductor elements linked respectively to the first conductor strips, carried by the dielectric plate and spaced out along the conductor strips, thereby forming an antenna network having a lobe scanning in a plane parallel to the conductor strips and perpendicular to the dielectric plate and conductor plate.

To produce a two-plane lobe scanning antenna network, lobe scanning means for each of the antenna formed by the first conductor strips are added to the antenna network defined above, in a plane perpendicular to the first conductor strips.

According to a first embodiment, the lobe scanning means includes a second phase shifter element embodying the invention, and several parallel conductor strips carried by the major face of the dielectric plate of the second phase shifter element and linked respectively to the ends of the first conductor strips. The conductor plate of the second phase shifter element comprises sections of different lengths respectively in respect to the second conductor strips. In this case, the antenna network comprises microwave microstrip structure type means in order to distribute the power from a tree-structured input conductor strip to the second conductor strips.

According to a second and highly compact embodiment, the lobe scanning means comprises a second phase shifter element embodying the invention, the conductor strip of the second phase shifter element is linked perpendicularly to the first conductor strips, and the conductor plate of the second phase shifter element is juxtaposed under the conductor strip of the second phase shifter element and moving in an opening made in the conductor plate of the first phase shifter element.

In the first and second embodiments, the conductor plate moving means in the first and second phase shifter elements are controlled independently of each other.

BRIEF DESCRIPTION OF THE DRAWING

Further advantages and features of the invention will be apparent from the following detailed description of several preferred embodiments of the invention referring to the corresponding appended drawings in which.

DESCRIPTION OF THE PREFERRED EMBODIMENTS

Figure 1:
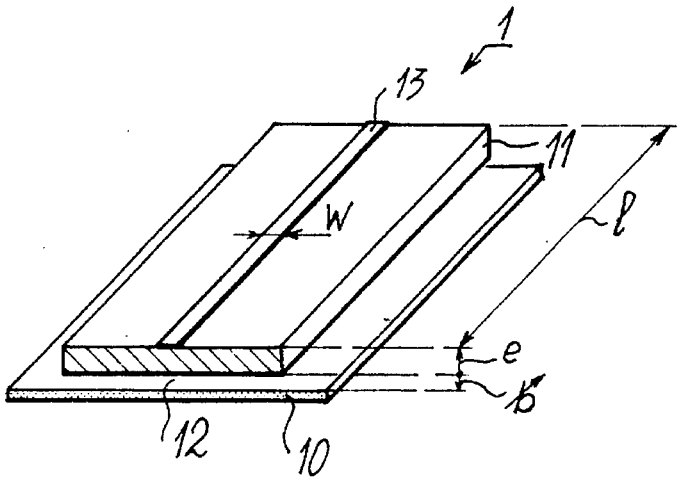
FIG. 1 is a schematic perspective view of a suspended dielectric and microstrip phase shifter element embodying the invention.

As shown schematically in FIG. 1, a phase shifter element 1 embodying the invention consists of a microwave transmission line of the "microstrip" type.

Element 1 comprises a flat metal conductor plate 10, forming a ground plane, and a substrate in the form of a dielectric plate 11 having a thin rectangular section and suspended parallel above the plate 10. Plate 11 is separated from plate 10 by an air gap 12 having a variable thickness b of the same order of magnitude, a few tens of millimeters, as that e of substrate 11. A thin flat straight conductor strip 13 is fastened or printed centrally and longitudinally on a major face of the substrate 11 and opposite to the air gap. Conductor strip 13 carried by plate 11 has a width W smaller than the width of plate 11 and a length l on plate 11 facing plate 10.

It will be remembered that, although empirical formulas are available and designed to determine the phase propagation constant β and characteristic impedance $Z_o$ of a microstrip line, the following simple formulas can be used approximating the mode of propagation in the line to a TEM mode:

$$\beta=(2\pi f/c)(\epsilon_{eff})^{1/2}$$

$$Z_o=(1/cK)(\epsilon_{eff})^{1/2}$$

in which f designates the operating frequency, e the speed of light in the void, K the lineic (per unit length) capacity for the line and $\epsilon_{eff}$ the effective permittivity of the line which is equal to the ration $\lambda_o/\lambda$ of the wavelength in the air $\lambda_o$, i.e., for an identical line but without dielectric material, and of the wave length λ guided in the line. The effective permittivity depends on the relative permittivity $\epsilon_r$ of the substrate 11 and the geometrical dimensions of the microstrip line.

In particular, the effective permittivity is practically in reverse proportion to the thickness b of the air gap 12, and consequently, the phase constant increases and the characteristic impedance decreases when the thickness b increases. In fact, as already stated, the invention makes use of a variation in the thickness b thereby producing a microwave phase shifter.

Thus, when the thickness b of air gap 12 varies from b=0 to a maximum value $b_m$, the variation in the phase constant is indicated by:

$$\Delta\beta=|\beta(b=0)-\beta(b=b_m)|=(2\pi f/c)|\ (\epsilon_{eff}(b=0))^{1/2}-(\epsilon_{eff}(b=b_m))^{1/2}|$$

With a predetermined length l of conductor strip 13 on the substrate, here corresponding to that of variable-thickness air gap 12, the total variation in the phase constant of the line is indicated by:

$$\Delta\beta.l=(2\pi f/c).l|(\epsilon_{eff}(b=0))^{1/2}-(\epsilon_{eff}(b=b_m))^{1/2}|$$

As to the characteristic impedance, we obtain with b=0: $Z_o=(1/(c.K(b=0)))(\epsilon_{eff}(b=0))^{1/2}$, and with $b=b_m$: $Z_o=(1/(c.K(b_m)))(\epsilon_{eff}(b_m))^{1/2}$.

So as to assess the order of magnitude of the two characteristics Δβ and $Z_o$, two practical examples easy to obtain are considered below.

EXAMPLE 1

Take a first microstrip line with suspended dielectric substrate, having the following features:

Substrate 11 in alumina of relative permittivity $\epsilon_r$=10 and thickness e=0.635 mm;

Central conductor strip 13 offering a characteristic impedance $Z_o(b=b_m)$=50 Ohm, when air gap 12 has a thickness $b_m$=0.3 mm, which defines a width W of strip 13 such that W=2.07 mm. When the thickness of air gap b varies from $b_m$=0.3 mm to b=0, the variation in the phase constant of the first line is:

Δβ(in °/cm)=12.5 ×f (in GHz).

I.e.,

125°/cm for 10 GHz, and

200°/cm for 16 GHz, and the characteristic impedance of the first line at variable air gap varies from:

$Z_c$(b=0.3 mm)=50 Ohm to $Z_c$(b=0)=25 Ohm.

EXAMPLE 2

Take a second microstrip line with suspended dielectric substrate, having dimensional features similar to those in example 1, except for the nature of the dielectric material:

Substrate 11 in magnesium titanate (MgTi) of relative permittivity $\epsilon_r$=13 and thickness e=0.635 mm;

Central conductor strip 13 offering a characteristic impedance $Z_o(b=b_m)$ of 50 Ohm when air gap 12 has a thickness $b_m$=0.3 mm which defines a width W of strip 13 such that W=1.87 mm. When the thickness b of the air gap varies from $b_m$=0.3 mm to b=0, the variation in the phase constant of the second line is:

Δβ(in °/cm)=15.3°×f (in GHz).

I.e.,

153°/cm for 10 GHz and

245°/cm for 16 GHz, and the characteristic impedance of the second line varies from:

$Z_c$(b=0.3 mm)=50 Ohm to $Z_c$(b=0)=24 Ohm.

These two examples, east to obtain in practice, shows that an extremely high phase shifter efficiency Δβ can be obtained. In fact the variable β is an increasing function of the permittivity of the employed dielectric material and of the operating frequency. As a comparaison, it should be observed that a ferrite phase shifter with a microstrip line type structure, i.e., with a ferrite substrate in place of air gap 12, provides efficiency of approximately 40°–50°/cm, with phase shift frequencies in the region of 10 GHz.

It should be stressed that, for a phase shifter embodying the invention, the efficiency Δβ is in proportion to the frequency, whereas with a ferrite phase shifter, the efficiency Δβ reduces with the frequency owing to the frequency dependency of the ferrite permeability tensor.

In practice the dielectric material must be chosen together with its thickness e according to the use frequency range.

For wide band applications corresponding to frequencies above 20 GHz the use of a dielectric substrate is recommended with a relatively low permittivity, for example in quartz crystal with a relative permittivity of $\epsilon_r$=3.8. This choice is essential if a certain dispersion of the characteristics is to be avoided and minimum insertion losses are to be obtained.

Figure 2:
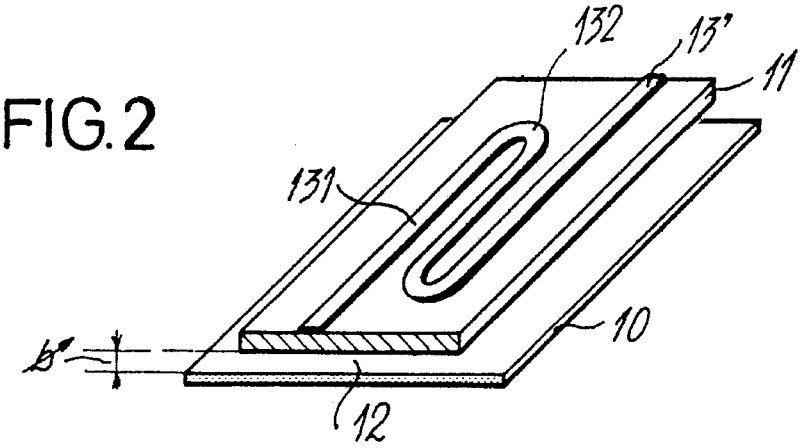
FIG. 2 is a view similar to that in FIG. 1, showing a conductor strip winding through a phase shifter element.

For application with relatively low frequencies, for example below 2 GHz, in order to obtain phase shifters of acceptable length, it is preferable to use a dielectric substrate with a relatively high permittivity and provide a conductor strip 13' which is relatively long and compact as in windings carried by substrate 11. As shown in FIG. 2, such a conductor strip 13' includes, for example, three parallel longitudinal sections 131 connected by two 180° bends 132 and is symmetrical about a central point on the intermediate longitudinal section. This embodiment is possible because the phase shifter is thus fully reciprocal, each of the ends of the conductor strip being usable either as input to receive signals, or output to transmit signals. Furthermore, for low frequencies, the insertion losses, including the dielectric and conductor losses, of a microstrip line, are relatively low, so that a phase shifter element can be envisioned considerably long.

Figure 3:
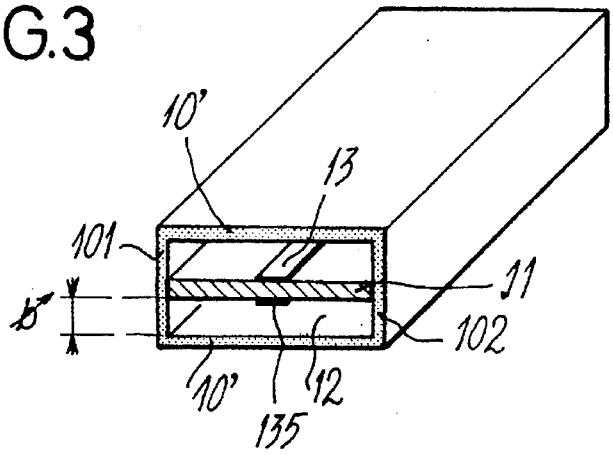
FIG. 3 is a schematic perspective view of a stripline and rectangular waveguide structure phase shifter element.

For applications with relatively high frequency ranges corresponding to the millimetric wave, it is preferable, in order to obtain low insertion losses, to employ the following techniques which are basically used to:

1. Avoid and thus reduce losses through radiation. Dielectric substrate 11 with central conductor strip 13 is "suspended" parallel between two ground plates 10', so as to form a triple plate type transmission line, or is "suspended" and placed longitudinally in a rectangular waveguide section, and parallel between two large walls 10' of the guide and is enclosed by two small walls 101 and 102 of the waveguide, as shown in FIG. 3. The dimensions of the waveguide are selected depending on the operating frequency range. According to another embodiment, two central superposed and parallel conductor stripe 13 and 135 are fastened or printed respectively on the major upper and lower faces of the dielectric plate 11 to form a "double microstrip" or "stripline" phase shifter element.

2. Avoid exciting TM modes. For this purpose is used a dielectric having a low permittivity, for example $\epsilon_r \cong 3.8$ or $\epsilon_4 \cong 2.2$, and a relatively thin thickness, for example e=0.254 mm or e=0.127 mm. This choice further contributes to reducing the insertion losses in the millimetric wave applications.

3. Reduce the conductive losses and thus avoid operating the microstrip line with a zero thickness air gap. Otherwise stated, the thickness b of air gap 12 varies on either side of the maximum thickness $b_m$, between two nonzero predetermined thicknesses. As the efficiency of the phase shifter element is extremely high in millimetric waves, a very slight variation in the thickness of the air gap is sufficient to obtain a 360° phase shift.

Figure 4:
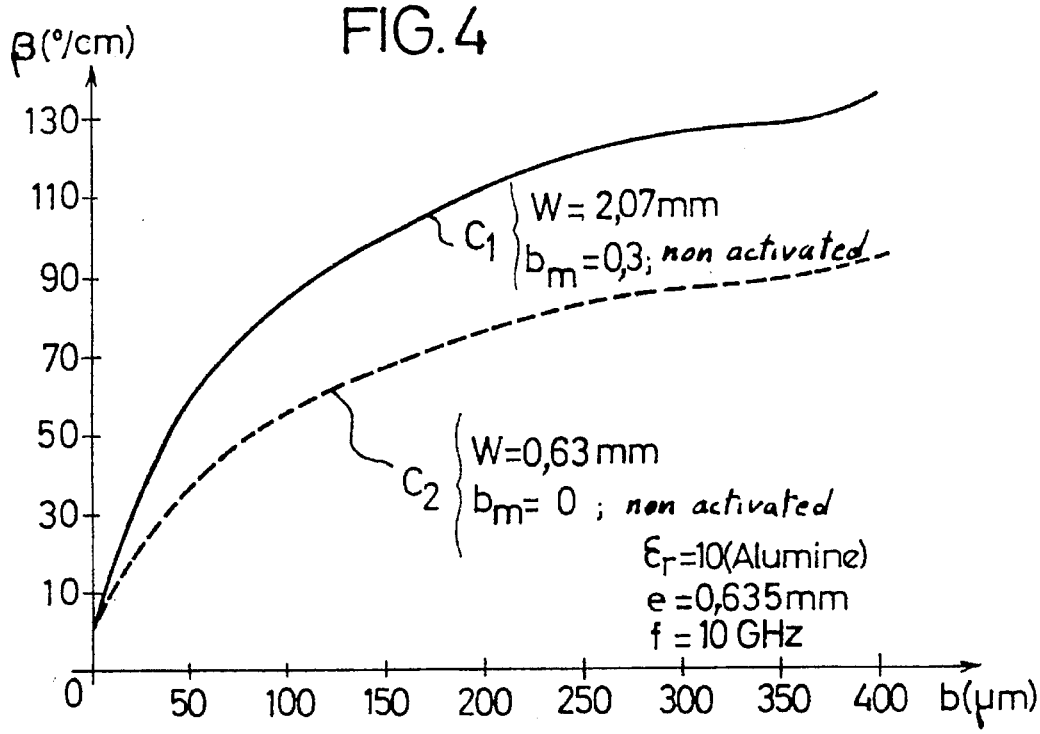
FIG. 4 shows two phase constant variation curves depending on the thickness of the air gap for two phase shifter elements, as shown in FIG. 1, having different conductor strip width, respectively.

Two theoretical curves $C_1$ and $C_2$ of the variation in phase constant $\beta$ depending on the thickness b of the air gap are shown in FIG. 4. Curves $C_1$ and $C_2$ concern phase shifter elements having an alumina substrate of thickness e=0.635 mm and operating at a frequency f=10 GHz. Curve $C_1$ corresponds to a central conductor strip of width W=2.07 mm and to a conductor plate-10 moving means of piezoelectric biplate type deformable towards the dielectric substrate as described further on referring to FIG. 9B, the moving means when in neutral, unactivated, positioning the conductor plate at a distance $b_m$=0.3 mm from the dielectric substrate. Curve $C_2$ corresponds to a central conductor strip of width W=0.63 mm and to a piezoelectric biplate deformable to the direction opposite the dielectric substrate, as described further on referring to FIG. 9C, the latter biplate being in neutral when the conductor plate is against the dielectric substrate.

Figure 5:
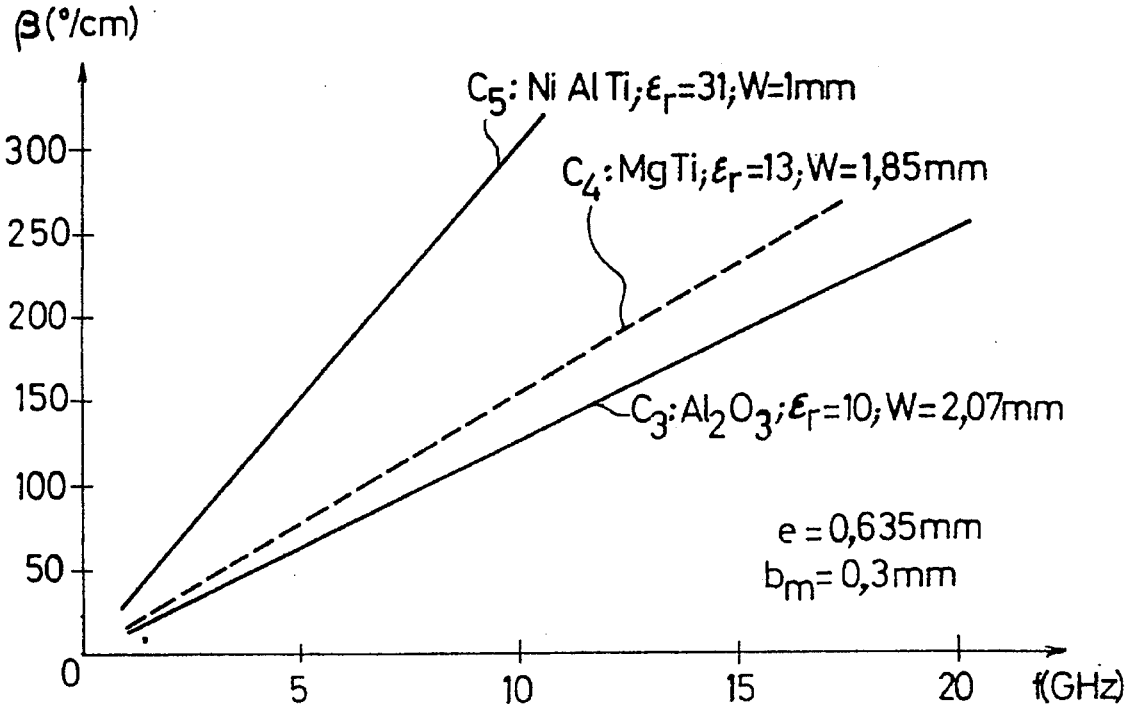
FIG. 5 shows three phase constant variation curves depending on the operating frequency for three phase shifter elements, as shown in FIG. 1, having relative different permittivities of dielectric material, respectively.

In FIG. 5, three curves $C_3$, $C_4$ and $C_5$ show the variation in phase constant $\beta$ depending on the operating frequency f. These curves correspond to an air gap with a maximum thickness $b_m$=0.3 mm and a dielectric plate with thickness e=0.635 mm carrying a central conductor strip, having width W respectively equal to 2.07 mm; 1.85 mm; 1 mm. The dielectric materials corresponding to curves $C_3$, $C_4$ and $C_5$ are respectively $Al_2O_3$, Mg Ti and Ni Al Ti with relative permittivities $\epsilon_r$ of 10, 13 and 31.

Figure 6A:
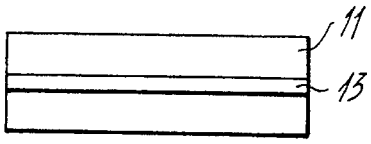
FIGS. 6A and 6B are longitudinal top and cross-sectional views of a phase shifter element including mechanical means for moving a conductor plate, respectively.
Figure 6B:
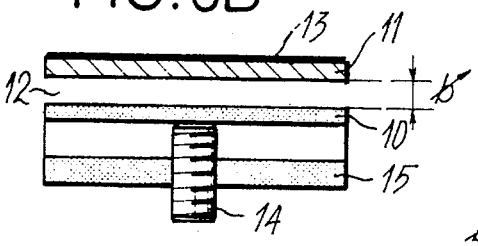
Figure 7:
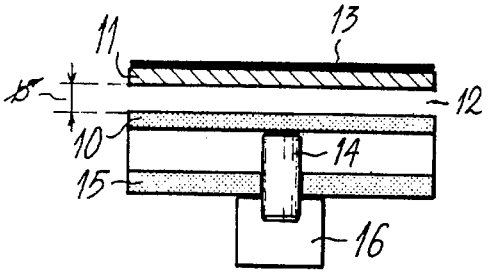
FIG. 7 is a longitudinal cross-sectional view of a phase shifter element including electromechanical means for moving a conductor plate.
Figure 8:
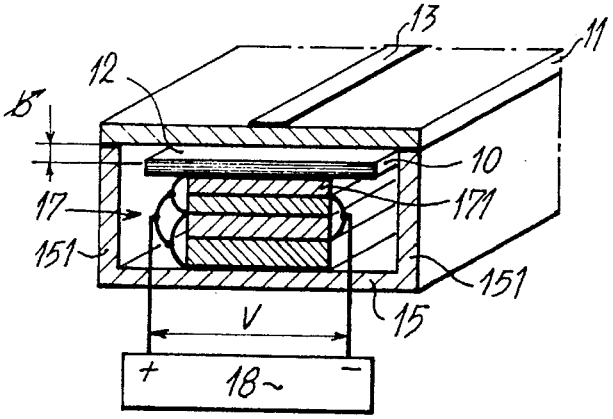
FIG. 8 is a perspective view of a phase shifter element including piezoelectric means for means a conductor plate.

According the invention, phase shifter element 1 comprises means for moving the ground conductor plate 10 and dielectric plate 11 in relation to each other, and preferably parallel to each other, to obtain reciprocal phase shift variations due to variations in thickness b of air gap 12. The moving means is for example provided with:

- a manual mechanism, such as a micrometer screw 14 which is screwed centrally into a base 15 subjacent to the rigid or flexible conductor plate 10 and an upper end whereof is fastened centrally under the movable ground plate 10, as shown in FIGS. 6A and 6B, or
- a miniature electric motor 16 placed under base 15 and rotating the micrometer screw 14, or imparting a translation movement to a rod crossing through base 15 and having an upper end carrying in the center the movable ground plate 10, as shown in FIG. 7; or
- a stack 17 of members, such as disks or washers, of piezoelectric material, fastened to base 15, the highest end disk 171 carrying, for example by cementing, movable ground plate 10, and a variable d.c. voltage V power source 18 having terminals respectively connected to terminals of the parallel-connected piezoelectric members, as shown in FIG. 8.

According to the three above embodiments, the stationary dielectric plate 11 can be "suspended" above the movable ground plate 10 via two shims 151 subjacent to the longitudinal edges of dielectric plate 11 and forming longitudinal arms or sides of base 15. The base then has a U cross-section and is equivalent to a half of a rectangular waveguide shown in FIG. 3.

Nevertheless it should be observed that the moving means comprising a piezoelectric stack member 17 offer advantages over the two other embodiments, i.e., very precise sensitivity to the displacement of ground plate 10, compactness of the phase shifter element and a low power consumption. An example of this preferred embodiment is described below in detail, assuming that the stack simply consists of two coupled piezelectric plates or thin reeds 171 and 172 forming a piezoelectric biplate and that the biplate is sufficient to obtain the required variation amplitude in the thickness b of air gap 12.

Figure 9A:
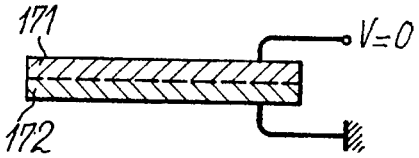
FIGS. 9A, 9B and 9C are schematic,longitudinal cross-sectional views of a piezoelectric biplate for moving a conductor plate, the biplate being designed to break and at positive and negative voltages, respectively.
Figure 9B:
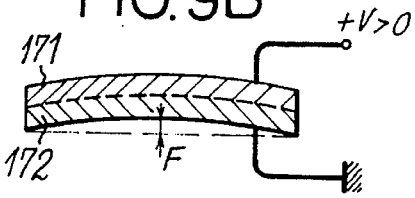
Figure 9C:
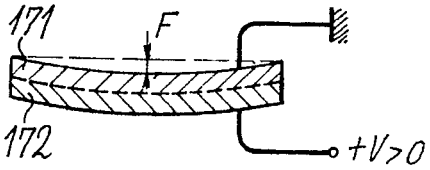

As shown respectively in FIGS. 9A, 9B and 9C, biplate 171-172 is flat when a supply voltage V provided by power source 18 is zero, and deforms into a convex or concave "cap" when the polarization of voltage V is positive or negative. During this deformation, the biplate shows a deflection F, in relation to its break position with V=0. Deflection F is an increasing function of the voltage applied V and is in proportion to the square of the length of the biplate. To make matters quite clear, a biplate of piezoelectric material available commercially and 50 mm long, creates a deflection F of about 0.3 mm.

Figure 10A:
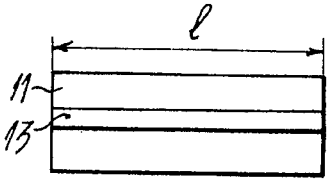
FIGS. 10A and 10B are longitudinal top and cross-sectional views of a phase shifter element including a piezoelectric biplate for moving a conductor plate, respectively.
Figure 10B:
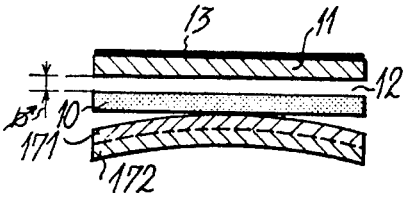
Figure 11A:
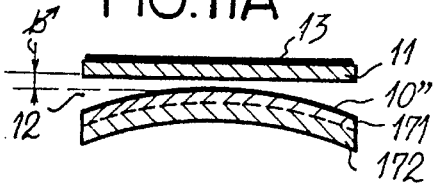
FIG. 11A is similar to FIG. 10B, the conductor plate being a metal layer deposited on the biplate.
Figure 11B:
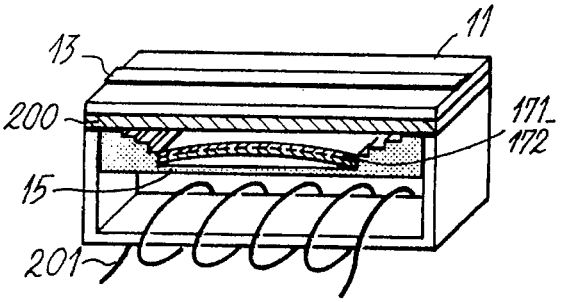
FIG. 11B is a view of an alternative embodiment of the phase shifter element employing a microstrip carried by a dielectric plate, a ferrite plate and metalized piezoelectric ceramics to vary the thickness of the air gap.

Two types of fastening the ground conductor plane 10 to the biplate 171-172 are considered according the invention, referring to FIGS. 10B and 11A–11B, and correspond to a convex deformation as indicated in FIG. 9B. For both these types of fastening, the curvature of the biplate is longitudinal under the central conductor strip 13, as shown in combination with FIG. 10A.

As shown in FIGS. 10A and 10B, the movable ground plate consists of a thin conductor plate 10 fastened centrally to the upper reed 171 of the piezoelectric biplate. Conductor plate 10 is moved parallel to the dielectric plate 11 and under it, through the deformation of the biplate. In this case, air gap 12 has a uniform thickness, whatever the value of this thickness.

According to the second type of fastening as shown in FIG. 11A, the movable ground plate consists of a metal layer 10" deposited on the upper face of the end reed 171 of the piezoelectric biplate. In this case, air gap 12 is not uniformly thick along the microstrip line. The line characteristics, such as phase constant and characteristic impedance, are obtained by an integral extended over the whole length of the line. With this second type 9 of ground plate fastening, efficiency is less than in the case of a uniform air gap, but there is a practical advantage. In fact, it is simple to use and the air gap offers a variant thickness, here decreasing progressively from each longitudinal input or output end of the phase shifter element to its center, which provides a certain impedance self-matching along the phase shifter element.

The alternative embodiment shown in FIG. 11*b* includes a ferrite plate 200 placed between the piezoelectric biplate 171-172 and dielectric plate 11 carrying conductor microstrip 13. A coil 201 connected to a variable electrical voltage source independent of the source supplying the biplate, varies the phase constant of the line. With this phase shifter structure it is possible to broaden the phase shift band and make minor variations in the phase shift at high speed around a fixed phase shift imposed by the biplate.

Figure 12:
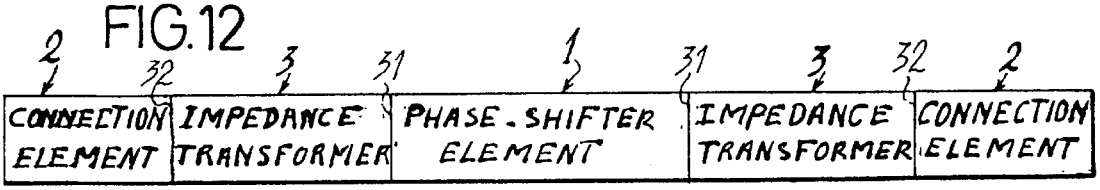
FIG. 12 shows a schematic block diagram of a complete phase shifter device as embodied by the invention.
Figure 16A:
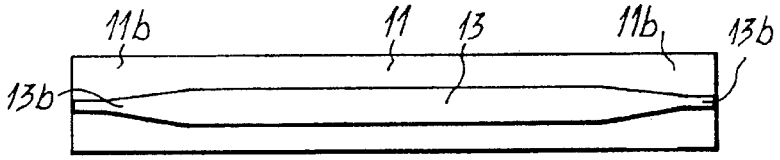
FIGS. 16A and 16B are longitudinal top and cross-sectional views of a phase shifter device including a biplate and two transformers, the thickness of whose air gap reduces continuously, respectively.
Figure 16B:
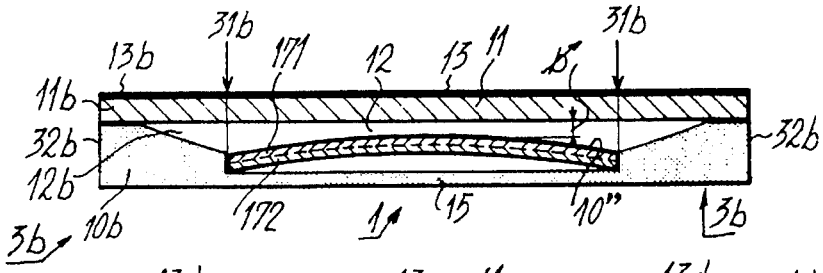
Figure 17A:
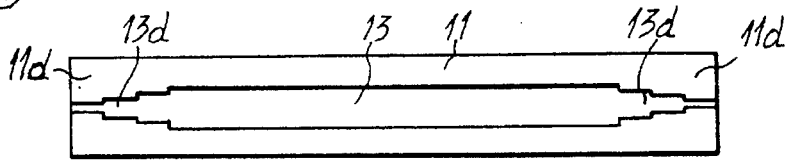
FIGS. 17A and 17B are longitudinal top and cross-sectional views of a phase shifter device including a biplate and two impedance transformers the width of whose conductor strip and thickness of whose air gap reduce discretely, respectively.
Figure 17B:
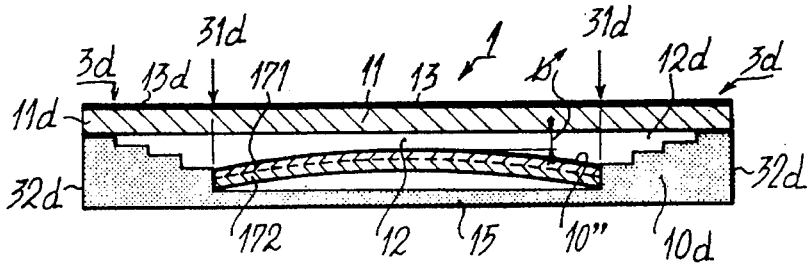

Generally speaking, a phase shifter element 1 embodying the invention is connected to external microwave circuits having a clearly defined characteristic impedance, typically 50 Ohm, via known microwave connection elements 2, such as two coaxial connectors or two rectangular waveguide sections enframing the ends or terminals of the phase shifter element. Nevertheless it is necessary to ensure impedance matching to the external circuits when the characteristic impedance of the phase shifter element varies. This impedance matching is obtained by two impedance transformers 3 consisting of nonuniform line sections and each interconnected between a respective longitudinal end of phase shifter element 1 and a respective connection element 2 as shown in FIG. 12. Thus in practice, a complete phase shifter device embodying the invention comprises two connection elements 2, of standard coaxial type or waveguide type, two impedance transformers 3 and the actual phase shifter element 1.

According to the type of connection element 2, it contains or is combined with a known microstrip-coaxial connector transition section, or to a known microstrip-waveguide transition section.

The nonuniform line section in an impedance transformer offers a characteristic impedance varying progressively along the longitudinal direction, from the characteristic impedance of the connection element 2 adjacent to a second end 32 of the transformer, to the characteristic impedance of the end of phase shifter element 1 adjacent to a first end 31 of the transformer. The transformer section has a microstrip type structure having a cross-section identical to that of the phase shifter element on the first end 31, and in particular, including a conductor strip and a ground conductor plate linked respectively to those of the phase shifter element.

Four examples of impedance transformer embodiment placed like the transformer to the left in FIG. 12, are shown in FIGS. 13A–13B, 14A–14B, 14C and 15A–15B respectively.

Figure 13A:
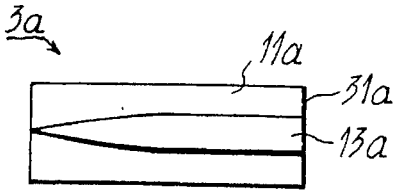
FIGS. 13A and 13B are longitudinal top and cross-sectional views of an impedance transformer without air gap, respectively.
Figure 13B:
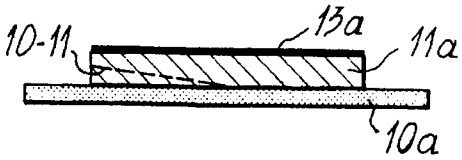

As shown in FIGS. 13A and 13B, a transformer 3*a* consists of a microstrip line without air gap, comprising a ground conductor plate 10*a* carrying a dielectric plate 11*a* itself carrying a thin or printed central conductor strip 13*a*. Strip 13*a* has a nonuniform width, reducing continuously after the first end 31*a* to the second end 32*a* of transformer 33*a*.

Figure 14A:
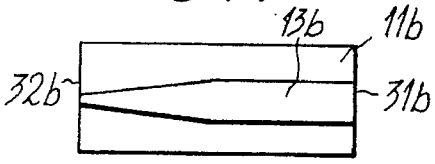
FIGS. 14A and 14B are longitudinal top and cross-sectional views of an impedance transformer including an air gap whose thickness reduces continuously and longitudinally, respectively.
Figure 14B:
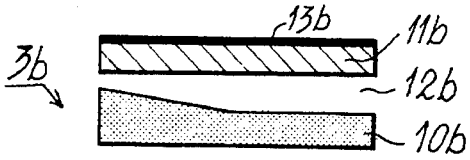
Figure 14C:
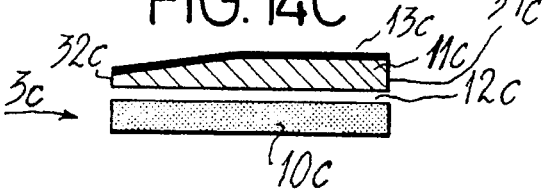
FIG. 14C is a longitudinal cross-sectional view combined with FIG. 14A showing an impedance transformer including a dielectric sheet whose thickness reduces continuously and longitudinally.

According to each of two embodiments indicated combining FIGS. 14A and 14B, and FIGS. 14A and 14C, a transformer 3*b*, 3*c* is formed by a microstrip line offering a vertical distance between a central conductor strip 13*b*, 13*c*, fastened or printed on a dielectric plate 11*b*, 11*c*, and the upper surface of a ground conductor plate 10*b*, 10*c*, the distance gradually reducing from the first end 31*b*, 31*c* to the second end 32*b*, 32*c*. For these two embodiments, the central conductor strip 13*b*, 13*c* has a width reducing like conductor strip 13*a*, and the transformer includes an air gap 12*b*, 12*c* between the suspended dielectric strip 11*b*, 11*c* and the ground plate 10*b*, 10*c*. According to the embodiment shown in FIG. 14B, the air gap 12*b* has a thickness reducing continuously after the first end 31*b* to the second end 32*b* via an increase in the thickness of the ground plate 10*b* along the same direction and opposite plate 11*b* which has a uniform thickness. According to the embodiment shown in FIG. 14C, dielectric plate 11*c* has a thickness reducing continuously after the first end 31*c* to the second end 32*c*, in the direction of the ground plate 10*c* which has a uniform thickness and which is parallel to the lower flat face of plate 11*c*. In an alternative embodiment, a transformer can include a combination of the dielectric plate 11*c* and ground plate 10*b*, or a dielectric plate and a ground plate with complementary longitudinal profiles, without air gaps between them, as shown by a dotted line 10-11 in FIG. 13B, or with an air gap between them.

Figure 15A:
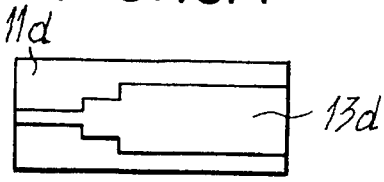
FIGS. 15A and 15B are longitudinal top and cross-sectional views of an impedance transformer including a conductor strip and air gap whose width and thickness reduce discretely and longitudinally, respectively.
Figure 15B:
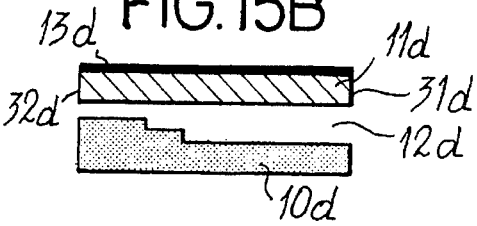

According to the fourth embodiment illustrated in FIGS. 15A and 15B, an impedance transformer 3*d* is substantially similar to transformer 3*b*, but the reduction in the width of the central conductor strip 13*d* and the increase in the thickness of ground plate 10*d* and hence the reduction in the thickness of air gap 12*d* very discretely, by steps or stages parallel to the dielectric plate 11*d* which has a uniform thickness. In an alternative embodiment, plate lid can also have a thickness reducing by stages towards the second end 32*d*.

Figure 18A:
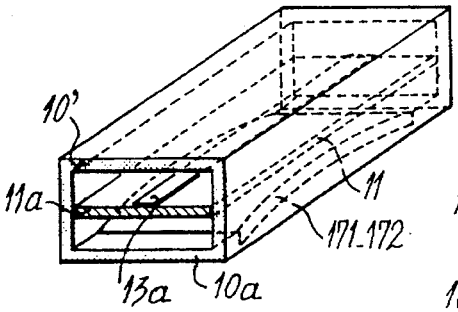
FIGS. 18A and 18B are longitudinal top and cross-sectional views of a phase shifter device with a rectangular wave guide structure including a biplate and two impedance transformers with uniform air gap thickness, respectively.
Figure 18B:
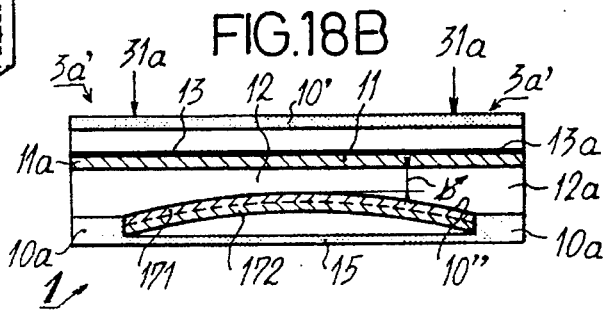

FIGS. 16A–16B and 17A–17B show respectively two compact, microstrip type phase shifter devices, including a phase shifter element 1 with piezoelectric biplate 171-172, as shown in FIG. 10A and 11A, and two impedance transformers 3*b*, 3*d* with an air gap 12*b*, 12*d* having a thickness at the second end 32*b*, 32*d*, the dielectric plates 11*b*, 11*d* resting on the second end of ground plate 10*b*, 10*c* in the transformer. FIGS. 18A and 18B show a compact unit of rectangular waveguide type, including a phase shifter element 1 with piezoelectric biplate 171-172, as shown in FIGS. 10A and 11A, and two impedance transformers 3*a'* similar to transformer 3*a*, but including an air gap 12*a* of uniform thickness. In these three phase shifter devices, the dielectric plate 11 of phase shifter element 1 and dielectric plates 11*b*, 11*d*, 11*a* of transformers 3*b*, 3*c*, 3*a'*, form a single integral dielectric plate to which a central integral conductor strip is fastened or printed, combining conductor strip 13 of the phase shifter element and the two conductor strips 13*b*, 13*c*, 13*a* of the transformers; likewise the metal bass 15 of the phase shifter element 1 and ground plates 10*b*, 10*c*, 10*a* are formed of an integral metal ground plate correctly machined to house biplate 171-172.

Figure 19:
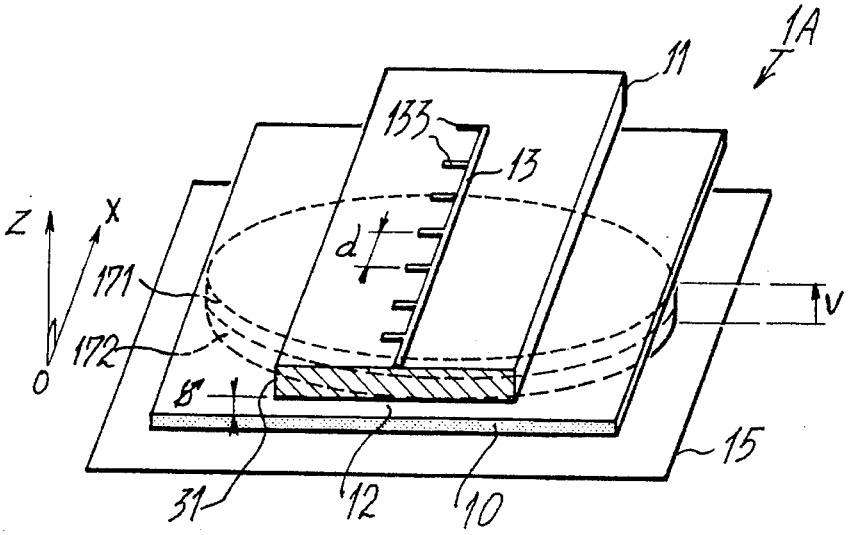
FIG. 19 is a perspective view of a first antenna network as embodied by the invention, including a phase shifter element with piezoelectric biplate.

Referring to FIG. 19, a linear network antenna basically comprises a phase shifter element 1A with a stationary, suspended dielectric plate 11, of the type shown in FIGS. 10A and 10B, but comprising a central, straight conductor strip 13 fitted with small conductors 133 which are arranged perpendicularly along the same side of conductor strip 13 and distributed regularly along it. The small conductors 133 are fastened to or printed on dielectric plate 11 and form radiating elements of the antenna linked to strip 13. A longitudinal end of conductor strip 13 terminates in a radiating element 133 on the dielectric plate, whereas the other longitudinal end 31 of conductor strip 13 is connected to microwave circuits via an impedance transformer 3 and a connection element 2 described above.

Lobe scanning of the antenna radiation pattern at a given operating frequency, i.e., at a given wavelength in air $\lambda_o$, corresponding to a variation in the wavelength $\lambda$ in the phase shifter element, is obtained, as embodied by the invention, by a variation in the thickness b of air gap 12. This variation in thickness is obtained, according to the illustrated embodiment, by variations in the control voltage V of piezoelectric biplate 171-172. The variation in thickness thus creates a change in the guided wavelength $\lambda$ resulting in a change in the direction of the maximum radiation $\theta$ of the antenna, according to the following relation:

$$\sin\theta=(\lambda_o/\lambda)-(\lambda_o/d)$$

in which d designates the distance between two adjacent radiating elements 133. Thus a lobe scan is obtained along the direction 0X longitudinal to the central conductor strip 13, i.e., in a vertical plane 0X-0Z perpendicular to plates 11 and 12 parallel to conductor 13.

Figure 20:
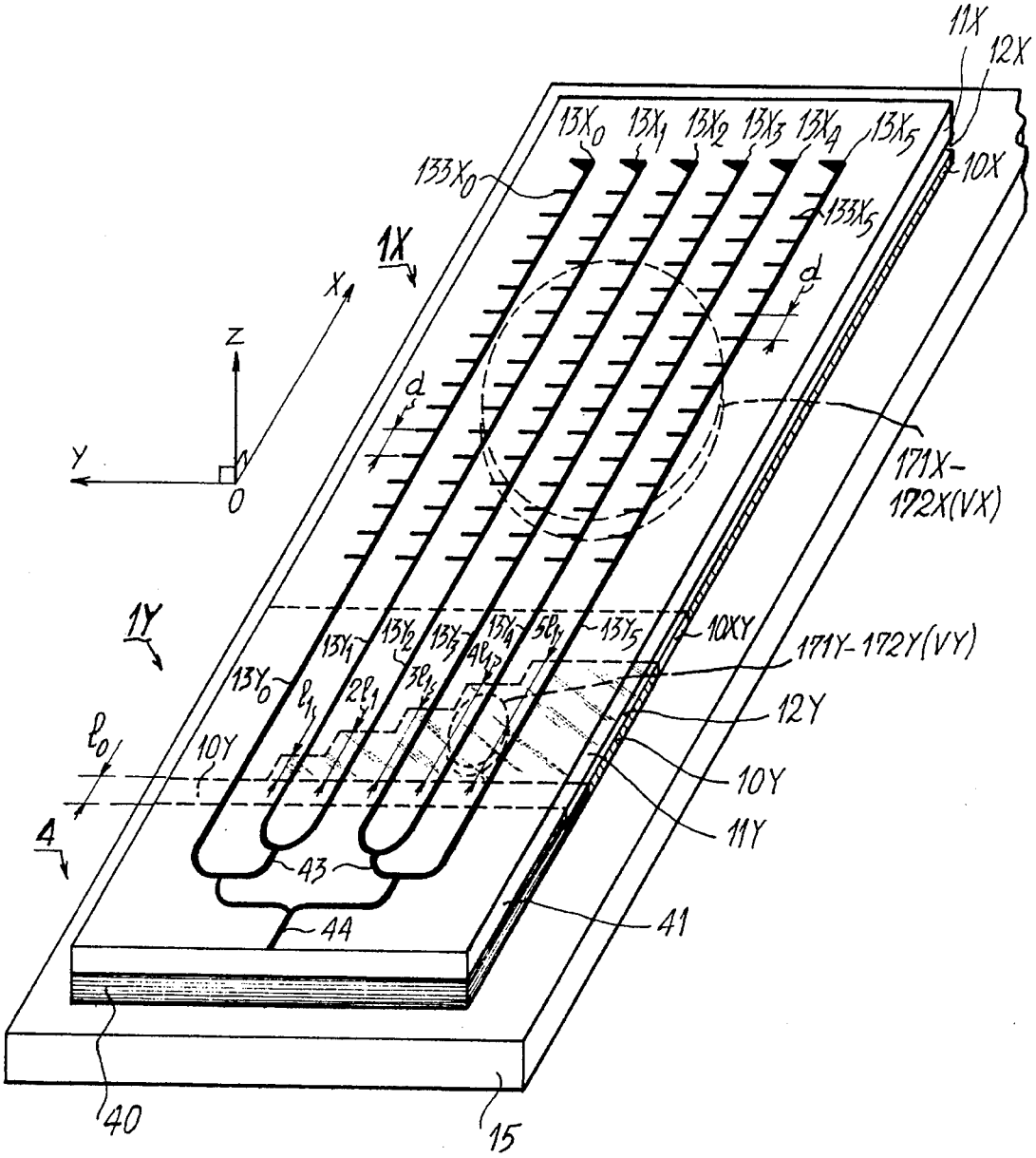
FIG. 20 is a perspective view of a first two-plane lobe scanning antenna network as embodied by the invention, including two phase shifter elements having several conductor strips and juxtaposed longitudinally, respectively.

Referring to FIG. 20, a two-plane lobe-scanning antenna network according to the first embodiment comprises a first phase shifter element 1X having a stationnary suspended dielectric plate 11X, of the type shown in FIGS. 10A and 10B, but having, instead of the central conductor strip 13, several parallel conductor strips, here the number being N=6, $\mathbf{13X_0}$ to $\mathbf{13X_{N-1}}=13_5$. Each conductor strip $\mathbf{13X_0}$ to $\mathbf{13X_5}$ is provided, as that of the antenna shown in FIG. 19, with small conductors forming radiating elements $\mathbf{133X_0}$ to $\mathbf{133X_5}$ linked perpendicularly to the same side of the conductor strip $\mathbf{13X_0}$ to $\mathbf{13X_5}$ and distributed regularly along it. Conductor strips $\mathbf{13X_0}$ to $\mathbf{13X_5}$ are fastened or printed parallel and coplanarly to the major upper face of wide dielectric plate 11X, which is superposed, through an air gap 12X of variable thickness, on a wide metal plate 10X forming a ground plane, movable by a first piezoelectric biplate 171X-172X disposed centrally under plate 10X. The variation in the thickness of air gap 12X by a control voltage VX applied to biplate 171X-172X implies a lobe scan of each for the antenna $\mathbf{13X_0}$-$\mathbf{133X_0}$ to $\mathbf{13X_{N-1}}$-$\mathbf{133X_{N-1}}$ along direction 0X in plane 0X-0Z.

The antenna network also comprises a second phase shifter element 1Y, of the same type as the first phase shifter element 1X but having a slotted metal ground plate 10Y. Thus, as shown in FIG. 20, the phase shifter element 1Y comprises

- a stationary, suspended dielectric plate 11Y which, with plate 11X, forms an integral rectangular dielectric plate of the antenna network,
- N=6 straight conductor strips $\mathbf{13Y_0}$ to $\mathbf{13Y_5}$ with extend colinearly with conductor strips $\mathbf{13X_0}$ to $\mathbf{13X_5}$,
- the ground conductor plate 10Y which is distinct and separated from plate 10X by a stationary, intermediate conductor plate 10XY and is placed under sheet 11Y via an air gap 12Y of variable thickness, and
- a piezoelectric biplate 172X-172Y which carries ground plate 10Y and to which a control voltage VY, independent of the voltage VX is applied.

The moving ground plate 10Y has a uniform thickness and contains, on the side of the phase shifter element 1X, slots having lengths $l_1$, $2l_1$, $3l_1$, $4l_1$, $5l_1$, so that lengths $l_0$, $l_1+l_1$, $l_0+2l_1$, $l_0+3l_1$, $l_0+4l_1$ and $l_0+5l_1$ of sections of plate 10Y are disposed respectively under parallel conductor strips $\mathbf{13Y_0}$ to $\mathbf{13Y_5}$ having identical lengths exceeding $l_0+5l_1$. The intermediate ground plate 10XY also contains slots in addition to those in plate 10Y and imbricating into them. The dimensions $l_0$ designates the width of a band of the plate 10Y perpendicular to conductor strips $\mathbf{13Y_0}$ to $\mathbf{13Y_5}$, here located opposite the phase shifter element 1X, and can be equal to zero.

Opposite element 1X and juxtaposed to element 1Y is provided a power distributor 4, of conventional type, with microstrip structure and no air gap. Distributor 4 comprises a ground plate 40 and a dielectric plate 41. Plate 41 is formed of a terminal portion of the dielectric plate common to the phase shifter elements 1X and 1Y and carries a network of tree-structured conductor strips 43 whereby a single conductor strip 44, leading from an impedance transformer is connected to conductor strips $\mathbf{13Y_0}$ to $\mathbf{13Y_{N-1}}$.

With its slotted profile, ground plate 10Y ensures a supply phased in with the network of linear antenna $\mathbf{13X_0}$-$\mathbf{133X_0}$ to $\mathbf{13X_{N-1}}$-$\mathbf{133X_{N-1}}$ so that the phase shifts entered by the elementary phase shifter including the longitudinal sections $l_0$, $l_0+l_1$, . . . , $l_0+(N-1)l_1$ of plate 10Y are:

$$\psi_0,\ \psi_0+\psi_1,\ \ldots,\ \psi_0+(N-1)\psi_1,$$

whatever the phase shifts $\psi_0$ and $\psi_1$ entered by the sections of respective lengths $l_0$ and $l_1$.

A variation in the thickness of air gap 12Y through variation in the control voltage VY results in a scan along a transverse direction 0Y perpendicular to the conductor strips $\mathbf{13X_0}$-$\mathbf{13Y_0}$ to $\mathbf{13X_{N-1}}$-$\mathbf{13Y_{N-1}}$, i.e., in a vertical plane 0Y-0Z perpendicular to the common dielectric plate 11X-11Y-41 and the ground plate 10X, 10XY, 10Y and 40. The length $l_1$ is chosen so as to obtain a 360° variation in the phase constant, account being taken of the maximum possible displacement of ground plate 10Y.

Through the two control voltages VX and VY of biplates 17IX-172X and 17IY-172Y a TV scanning type lobe scan can be obtained, that can also used to aim the beam in radars, notably on board aircrafts or special engines.

Figure 21A:
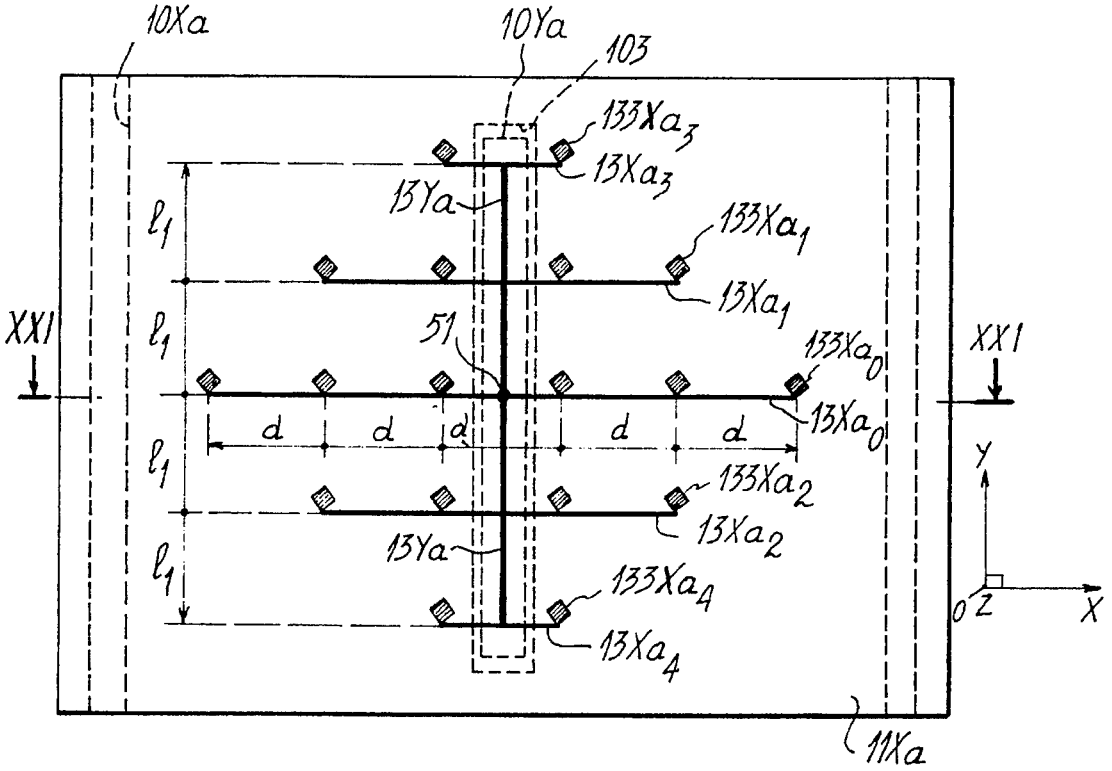
FIGS. 21A and 21B show a top and cross-sectional view taken along line XXI—XXI of FIG. 21A, of a second two-plane lobe scanning antenna network as embodied by the invention, including a first phase shifter element with several parallel conductor strips and a second phase shifter element with a central conductor strip and mediator of the first phase shifter element, respectively.
Figure 21B:
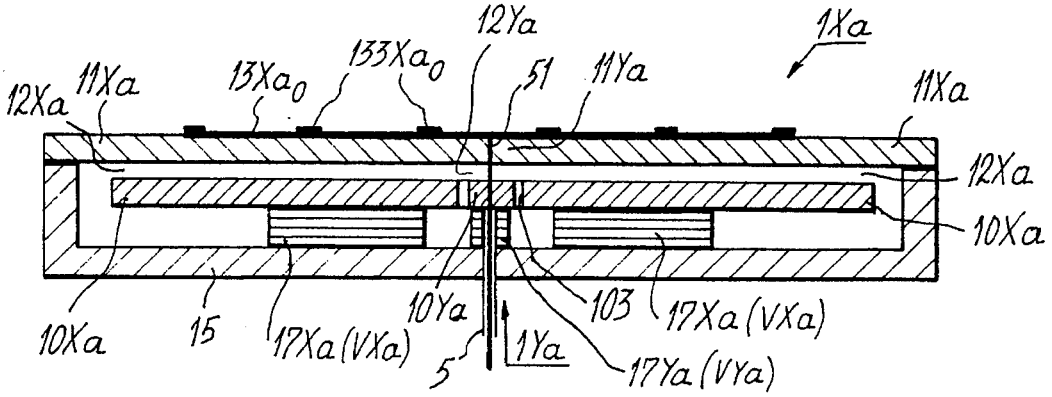

According to a second embodiment shown in FIGS. 21A and 21B, the two-plane lob-scanning antenna network also comprises two phase shifter elements 1XA and 1YA with microstrip and suspended dielectric structures.

The first phase shifter element **1X*a* comprises a large stationary rectangular plate 11X*a* in dielectric material, several parallel, straight conductor strips, here numbering 2M+1=5, $\mathbf{13Xa_0}$ to $\mathbf{13Xa_4}$ fastened or printed on the upper face of dielectric plate 11X*a*, a movable metal ground plate 10X*a* disposed under plate 11X*a* and separated from it by an air gap 12X*a* of variable thickness, and piezoelectric means 17X*a* for moving rectangular plate 10X*a***.

Conductor strips $\mathbf{13Xa_0}$ to $\mathbf{13Xa_4}$ are also provided with conductor radiating elements $\mathbf{133Xa_0}$ to $\mathbf{133Xa_4}$ distributed regularly on the same side of the conductor strips, and are parallel to the large sides of plate **11X*a* and distributed equally along the small axis of plate 11X*a*. According to the illustrated embodiment, the radiating element type conductor strips 133X*ap* to $\mathbf{133Xa_4}$ form a symmetrical log-periodic type antenna network. Conductor strip $\mathbf{13Xa_0}$ extends along the large axis of plate 11X*a* and comprises 2Q=6 radiating elements $\mathbf{133Xa_0}$, and has a length equal to (2Q−1)d=5d. Conductor strips $\mathbf{13Xa_1}$ to $\mathbf{13Xa_2}$ are arranged symmetrically about conductor strip $\mathbf{13Xa_0}$ and at a distance $l_1$ from it, and each contain 2Q−2=4 radiating elements $\mathbf{133Xa_1}$, $\mathbf{133Xa_2}$ and each have a length equal to (2Q−3)d=3d. Conductor strips $\mathbf{13Xa_3}$ and $\mathbf{13Xa_4}$ are disposed symmetrically about conductor strip $\mathbf{13Xa_0}$ and at a distance of $2l_1$ from it, and each contain 2Q−4=2 radiating elements $\mathbf{133Xa_3}$, $\mathbf{133Xa_4}$ and each have a length equal to d. Thus the antenna network is symmetrical to the center "51" of plate 11X*a***.

According to the illustrated embodiment, the means for moving plate 10X*a* includes two, or more, stacks of piezoelectic washers 17X*a* correctly and equally distributed under movable plate 10X*a* and carrying the latter. The stacks 17X*a* are carried by a base 15 in the form of a shaft supporting the periphery of plate 11X*a*. Stacks 17X*a* are supplied in-parallel by the same variable voltage source VX*a* so as to obtain a lobe scan of the antennae in a plane 0X-0Z parallel to conductor strips 13X$a_0$ to 13X$a_4$ and perpendicular to plates 10X*a* and 11X*a*.

The second phase shifter element 1Y*a* is located along the small axis of the first phase shifter element 1X*a* which confers lower dimensions and compactness as compared to the antenna network in the first embodiment. The compact feature is also due to the integration of a power distributor in element 1Y*a*.

Element 1Y*a* comprises a small, movable rectangular metal plate 10Y*a* which is disposed in a rectangular opening 103 made along the small axis of plate 10X*a* and whose dimensions substantially exceed those of plate 10Y*a*. Plate 10Y*a* has a width less than d, typically equal to d/2, and a length greater than $2\times M\times l_1$, typically in the region of $4.5l_1$. Above the ground plate 10Y*a* and separated from it by an air gap of variable thickness 12Y*a* is a stationary, rectangular dielectric sheet 11Y*a* integrated into plate 11X*a* and carrying a conductor strip 13Y*a* extending along the small axis of plate 11X*a*, merging with the large axis of plate 11Y*a* and thus mediating conductor strips 13X$a_0$ to 13X$a_4$, and having a length equal to $2\times M\times l_1=4l_1$. Above the ground plate 10Y*a* and separated from it by an air gap of variable thickness 12Y*a* is a stationary, rectangular dielectric sheet 11Y*a* integrated into plate 11X*a* and carrying a conductor strip 13Y*a* extending along the small axis of plate 11X*a*, merging with the large axis of plate 11Y*a* and thus mediating conductor strips 13X$a_0$ to 13X$a_4$, and having a length equal to $2\times M\times l_1=4l_1$. Thus, at the same time, firstly conductor strip 13Y*a* is linked to the centers of conductor strips 13X$a_0$ to 13X$a_4$ and thus distributes the power between them, and secondly, conductor strips 13Y*a* forms, in relation to its center linked to an internal conductor 51 of a coaxial line 5, two sections of length $l_1$ so as to produce two microstrip phase shifters with variable air gap supplying the intermediate antennae 13X$a_1$-133X$a_1$ and 13X$a_2$-133X$a_2$, and two sections of length $2l_1$ to produce two microstrip phase shifters with variable air gap supplying the far end antennae 13X$a_3$-133X$a_3$ and 13X$a_4$-133X$a_4$.

The phase shifter element 1Y*a* also comprises a stack of small piezoelectric washers 17Y*a* lying on a base 15 and supporting centrally the central ground plate 10Y*a*. Stack 17Y*a* is supplied by control voltage VY*a* independent of the voltage VX*a* to obtain a lobe scan of the antennae in a plane 0Y-0Z parallel to conductor strip 13Y*a* and perpendicular to conductor strips 13X$a_0$ to 13X$a_4$. Coaxial line 5 penetrates underneath into phase shifter element 1Y*a* and crosses through a central hole in the stack of piezoelectric washers 17Y*a*. Internal conductor 51 in line 5 freely crosses a central hole in plate 10Y*a* and air gap 12Y*a*, and penetrates into the central dielectric plate 11Y*a* in order to be linked to the center of conductor strip 13Y*a*. As embodied in another alternative, stack 17Y*a* is replaced by two stacks of piezoelectric washers controlled in-parallel by voltage VY*a* and carrying the longitudinal ends of plate 10Y*a*.

What we claim is:

1. A microwave phase shifter element operating in TEM mode, comprising a conductor plate, a dielectric plate superposed and substantially parallel to said conductor plate, a conductor strip carried by a major face of said dielectric plate for guiding a microwave through the phase shifter element, said microwave being fed by external microwave transmission means, an air gap having a variable thickness and located between said dielectric plate and said conductor plate, and means for moving one of said plates in relation to the other thereby modifying the thickness of said air gap.

2. A phase shifter element as claimed in claim 1, wherein said dielectric plate is stationary, and wherein said moving means carries said conductor plate and moves it between a first position remote from said dielectric plate and a second position substantially in contact with said dielectric plate.

3. A phase shifter element as claimed in claim 1, wherein said moving means is mechanical means of micrometer screw type carrying the movable plate.

4. A phase shifter element as claimed in claim 1, wherein said moving means are electromechanical means of one of a screw and or rod type, actuated by an electric motor and carrying said movable plate.

5. A phase shifter element as claimed in claim 1, wherein said moving means is piezoelectric moving means carrying said movable plate and deformable by supply of a variable control voltage.

6. A phase shifter element as claimed in claim 5, wherein said piezoelectric moving means comprises at least a stack of piezoelectric members, said stack having an end piezoelectric member carrying said movable plate.

7. A phase shifter element as claimed in claim 6, wherein said stack is a piezoelectric biplate.

8. A phase shifter element as claimed in claim 6, wherein said dielectric plate is stationary and said conductor plate is fastened by cementing centrally on said end piezoelectric member.

9. A phase shifter element as claimed in claim 6, wherein said dielectric plate is stationary and said conductor plate is a metal layer deposited on said end piezoelectric member.

10. A phase shifter element as claimed in claim 1, wherein said conductor strip is printed on a major face of said dielectric plate opposite said air gap.

11. A phase shifter element as claimed in claim 1, wherein said conductor strip has a serpentine shape.

12. A phase shifter element as claimed in claim 1, comprising a ferrite plate disposed between said dielectric plate and said conductor plate, a coil cooperating with said ferrite plate, and a variable voltage source independent of said moving means for supplying said coil.

13. A phase shifter element as claimed in claim 1, comprising means for reducing radiation losses.

14. A phase shifter element as claimed in claim 13, wherein said radiation losses reducing means comprises a second conductor plate substantially parallel to said dielectric plate, said phase shifter element having a triple plate type structure.

15. A phase shifter element as claimed in claim 14, wherein a second conductor strip is carried by another major face of said dielectric plate and is superposed on said first conductor strip, said phase shifter element having a stripline type structure.

16. A phase shifter element as claimed in claim 14, wherein said radiation losses reducing means comprises two conductor walls substantially perpendicular to said two conductor plates so that said conductor walls and plates enframe said dielectric plate and form a rectangular waveguide.

17. A microwave phase shifter device, comprising a phase shifter element operating in TEM mode and comprising a conductor plate, a dielectric plate superposed and substantially parallel to said conductor plate, a conductor strip carried by a major face of said dielectric plate for guiding a microwave through said phase shifter element, said microwave being fed by external microwave transmission means, an air gap having a variable thickness and located between said dielectric plate and said conductor plate, and means for moving one of said plates in relation to the other thereby modifying the thickness of said air gap, and impedance transformation means linked to one of the ends of said conductor strip and said conductor plate for matching the characteristic impedance of said phase shift element to that of the external microwave transmission means.

18. A phase shifter device as claimed in claim 17, wherein said impedance transformation means has a microwave microstrip type structure comprising a conductor strip that is linked to one end of said conductor strip of said phase shifter element and that has a width reducing continuously by stages from, at the most, said conductor strip end.

19. A phase shifter device as claimed in claim 18, wherein said impedance transformation means comprises a dielectric plate carrying said conductor strip of reducing width, and a conductor plate carrying said dielectric plate of said impedance transformation means.

20. A phase shifter device as claimed in claim 18, wherein said impedance transformation means comprises a dielectric plate carrying said conductor strip of reducing width and a conductor plate separated from said dielectric plate of said impedance transformation means via an air gap at least at the level of said end of said phase shifter element conductor strip.

21. A phase shifter device as claimed in claim 20, wherein said air gap in said impedance transformation means has one of a uniform thickness and reduces continuously by stages, at the most, from said end of said phase shifter element conductor strip.

22. A phase shifter device as claimed in claim 18, wherein said impedance transformation means comprises a dielectric plate carrying said conductor strip of reducing width, and a conductor plate disposed substantially parallel to said dielectric plate of said impedance transformation means, said dielectric plate in said impedance transformation means having a thickness reducing continuously by stages, at most, from said end of said phase shifter element conductor strip, the distance between said conductor strip and said conductor plate reducing, at most, from said end.

23. A phase shifter device as claimed in claim 18, wherein said impedance transformation means comprises a dielectric plate carrying said conductor strip of reducing width, and a conductor plate disposed substantially parallel to said dielectric plate of said impedance transformation means, said conductor plate in said impedance transformation means having a thickness increasing continuously by stages, at most, from said end of said phase shifter element conductor strip, the distance between said conductor strip and said conductor plate reducing at most from said end.

24. A phase shifter device as claimed in claim 18, wherein said impedance transformation means comprises a dielectric plate carrying said conductor strip of reducing width, and a conductor plate disposed substantially parallel to said dielectric plate of said impedance transformation means.

said dielectric plates in said phase shifter element and in said impedance transformation means forming an integral dielectric plate, and wherein a base in said phase shifter element carries said moving means, and said conductor plate in the impedance transformation means and said base form an integral metal part carrying said integral dielectric plate.

25. A phase shifter device as claimed in claim 18, comprising a second impedance transformation means linked to another end of said conductor strip and conductor plate of said phase shifter element.

26. A network of antenna operating in TEM mode, comprising a conductor plate, a dielectric plate superposed and substantially parallel to said conductor plate, a conductor strip carried by a major face of said dielectric plate for guiding a microwave through the antenna, said microwave being fed by external microwave transmission means, an air gap having a variable thickness and located between said dielectric plate and said conductor plate, means for moving one of said plates in relation to the other thereby modifying the thickness of said air gap, and radiating conductor elements linked to said conductor strip and carried by said dielectric plate and spaced out along said conductor strip.

27. A network antenna as claimed in claim 26, comprising impedance transformation means linked to an end of said conductor strip and said conductor plate for matching the characteristic impedance of said network antenna to that of the external microwave transmission means.

28. An antenna network operating in TEM mode, comprising a first conductor plate, a first dielectric plate superposed and substantially parallel to said first conductor plate, a plurality of first linked conductor strips carried by a major face of said first dielectric plate for guiding a microwave through the antenna network, said microwave being fed by external microwave transmission means, a first air gap having a variable thickness and located between said first dielectric plate and said first conductor plate, first means for moving one of said first plate in relation to the other, thereby modifying the thickness of said first air gap, and radiating conductor elements linked respectively to said first conductor strips and carried by said dielectric plate and spaced out respectively along said first conductor strips.

29. An antenna network as claimed in claim 28 comprising lobe scanning means for each of the antennae formed by said first conductor strips, the lobe scanning being located i a plane perpendicular to said first conductor strips.

30. An antenna network as claimed in claim 29, wherein said lobe scanning means comprises a second conductor plate, a second dielectric plate superposed and substantially parallel to said second conductor plate, a plurality of second conductor strips carried by a major face of said second dielectric plate and respectively linking said first conductor strips to a common terminal.

a second air gap having a variable thickness and located between said second dielectric plate and said second conductor plate, and second means for moving one of said second plates in relation to the other thereby modifying the thickness of said second air gap, said second conductor plate comprising sections of different lengths respectively opposite said second conductor strips.

31. An antenna network as claimed in claim 30 comprising means with microwave microstrip structure for distributing power from a tree-structured input conductor strip to said second conductor strips.

32. An antenna network as claimed in claim 29, wherein said lobe scanning means comprises a second conductor plate, a second dielectric plate superposed and substantially parallel to said second conductor plate, a second conductor strip carried by a major face of said second dielectric plate and linked perpendicularly to said first conductor strips, a second air gap having a variable thickness and located between said second dielectric plate and said second conductor plate, and second means for moving one of said second plates in relation to the other thereby modifying the thickness of said second air gap, said second conductor plate being juxtaposed under said second conductor strip and moving in an opening made in said first conductor plate.

33. An antenna network as claimed in claim 32, wherein said second conductor strip is mediator of said first conductor strips.

34. An antenna network as claimed in claim 32, wherein said second conductor plate has a width less than the distance between two adjacent radiating elements along a same first conductor strip.

35. An antenna network as claimed claim 32, wherein an internal conductor in a coaxial line has an end emerging from said line which crosses through the thicknesses of said second conductor plate, said second air gap and said second dielectric plate, so as to be linked to said second conductor strip.

36. An antenna network as claimed in claim 35, wherein said second moving means carries centrally said second conductor plate and is crossed through by said coaxial line.

37. An antenna network as claimed claim 30, wherein said first and second moving means are controlled independently of each other.

* * * * *